US005355588A

United States Patent [19]

Brandenburg, Jr. et al.

[11] Patent Number: 5,355,588

[45] Date of Patent: Oct. 18, 1994

[54] ROTARY CUTTING BLADE ASSEMBLY FOR A HAND-HELD CUTTER

[75] Inventors: Lloyd W. Brandenburg, Jr.; Charles S. Ramsey, both of Wausau, Wis.

[73] Assignee: Fiskars Inc., Wausau, Wis.

[21] Appl. No.: 944,870

[22] Filed: Sep. 14, 1992

Related U.S. Application Data

[63] Continuation-in-part of Ser. No. 821,593, Jan. 15, 1992, abandoned, and a continuation-in-part of Ser. No. 926,212, Aug. 5, 1992, Pat. No. Des. 342,883.

[51] Int. Cl.[5] ..... B26B 3/08

[52] U.S. Cl. ..... 30/319; 30/292; 30/307

[58] Field of Search ..... 30/162, 292, 307, 319

[56] References Cited

U.S. PATENT DOCUMENTS

| | | | |
|---|---|---|---|
| D. 200,335 | 2/1965 | Larson | 30/319 |
| 209,065 | 10/1878 | Millspaugh | 30/319 |
| 1,284,658 | 11/1918 | Gullborg | 30/307 |
| 1,487,226 | 3/1924 | Frahm | 30/319 |
| 2,526,154 | 10/1950 | Parks | 30/307 |
| 3,924,328 | 12/1975 | Mould | 30/307 |
| 4,432,137 | 2/1984 | Okada | 30/292 |
| 5,101,564 | 4/1992 | Melter | 30/292 |

FOREIGN PATENT DOCUMENTS 2419859 11/1975 Fed. Rep. of Germany .

*Primary Examiner*—Richard K. Seidel
*Assistant Examiner*—Paul M. Heyrana, Sr.
*Attorney, Agent, or Firm*—Foley & Lardner

[57] ABSTRACT

A rotary cutter having a handle, a cylindrical head formed on one end of the handle and having a planar surface on each side of the head, an actuating member pivotally mounted in the head, a circular blade mounted on the actuating member and having a pinking or wave shaped cutting edge offset from the blade to form a hub, the blade being secured to one side of the actuating member with the hub located in a parallel relation to one of the planar surfaces, and a finger guard formed as an integral part of the handle and head.

6 Claims, 4 Drawing Sheets

ROTARY CUTTING BLADE ASSEMBLY FOR A HAND-HELD CUTTER

RELATED APPLICATIONS

The present invention is a continuation-in-part Design Applications Ser. No. 07/821,593 entitled "Circular Pinking Blade Or Similar Article," filed on Jan. 15, 1992, now abandoned, and Ser. No. 07/926,212, entitled "Circular Wave Blade Or Similar Article," filed on Aug. 5, 1992, now U.S. Design 342,883.

FIELD OF THE INVENTION

The present invention relates generally to hand-held cutting tools and, more particularly, to a cutting blade having a pinking or wave cutting edge.

BACKGROUND OF THE INVENTION

A hand-held rotary cutter of the type contemplated herein is shown and described in U.S. Pat. No. 5,101,564, entitled "Hand-Held Cutter Having A Rotatable Circular Blade And Safety Guard," issued on Apr. 7, 1992. The rotary cutter of the type described in this patent generally includes a hand-held handle having a generally circular head mounted on one end which includes an internal cavity and a planar surface on each side. An activating member is pivotably mounted in the cavity for supporting a cutter blade on one of the planar surfaces of the circular head with the blade being retractable to a guarded position in close proximity to the planar surface of the head, and being movable in an arcuate path to expose the edge of the blade for cutting.

SUMMARY OF THE PRESENT INVENTION

In accordance with the present invention a cutter blade is provided which includes a cutting edge having a pinking or wave form which is offset from the planar surface of the blade, the blade being mountable upon the rotary head for movement between storage and cutting positions.

In accordance with another aspect of the invention a finger guard is provided which prevents the forward movement of the fingers during a cutting stroke.

A further advantage of the invention relates to the ability to interchange the cutter blades to accommodate different cutting patterns.

Other principal features and advantages of the invention will become apparent to those skilled in the art upon review of the following drawings, the detailed description and the appended claims.

BRIEF DESCRIPTION OF THE DRAWING

A preferred exemplary embodiment of the present invention will be described in conjunction with the appended drawing, wherein like numerals denote like elements, and.

Figures 1, 2, 2A:
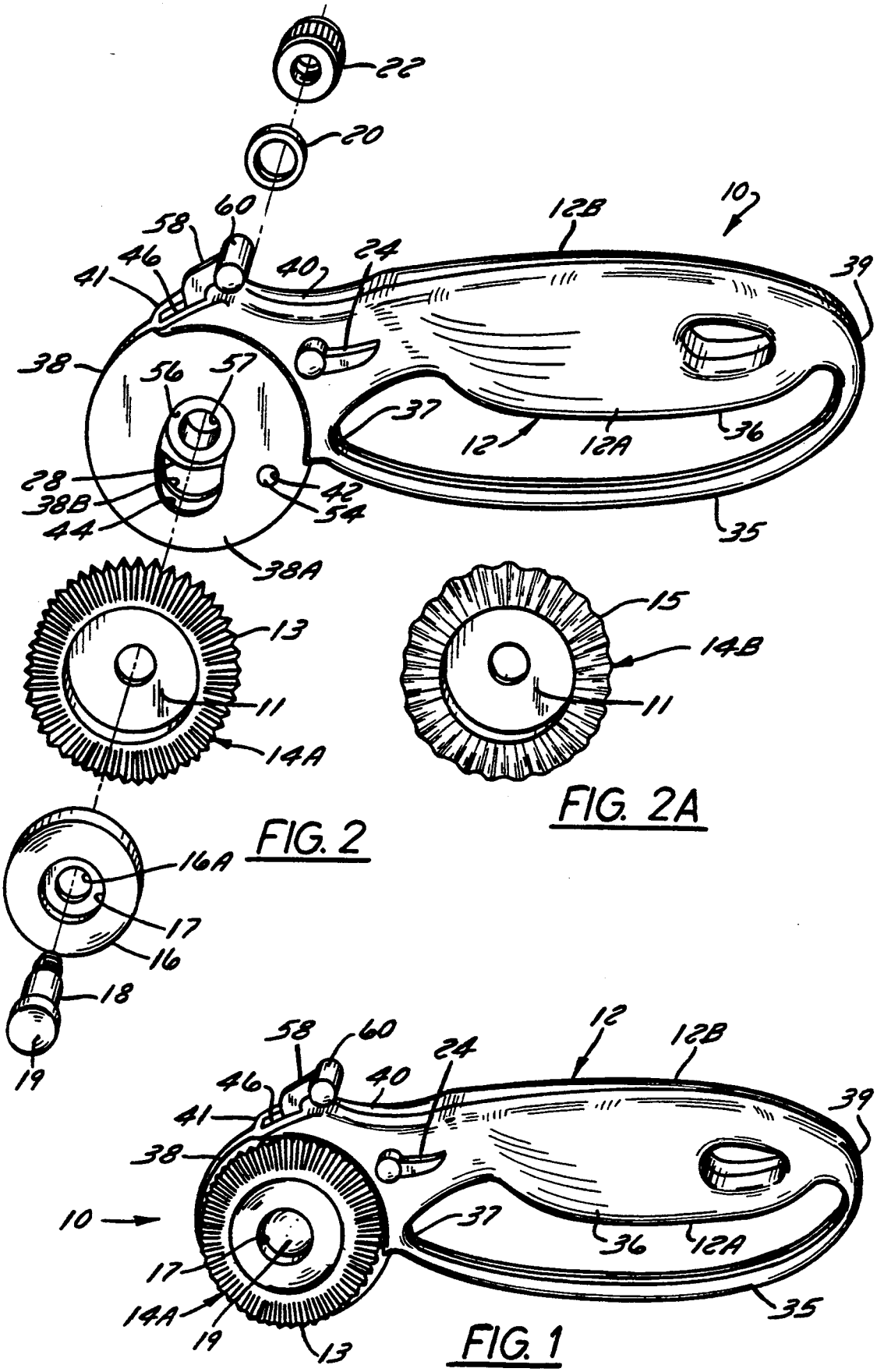
FIG. 1 is a perspective view of a hand-held rotary cutter in accordance with the present invention.
FIG. 2 is an exploded view of the cutter assembly of the rotary cutter of FIG. 1.
FIG. 2A is an alternate form of the cutter blade.

Before explaining at least one embodiment of the invention in detail it is to be understood that the invention is not limited in its application to the details of construction and the arrangement of the components set forth in the following description or illustrated in the drawings. The invention is capable of other embodiments or being practiced or carried out in various ways. Also, it is to be understood that the phraseology and terminology employed herein is for the purposes of description and should not be regarded as limiting.

DETAILED DESCRIPTION OF THE PREFERRED EMBODIMENTS

Figure 3:
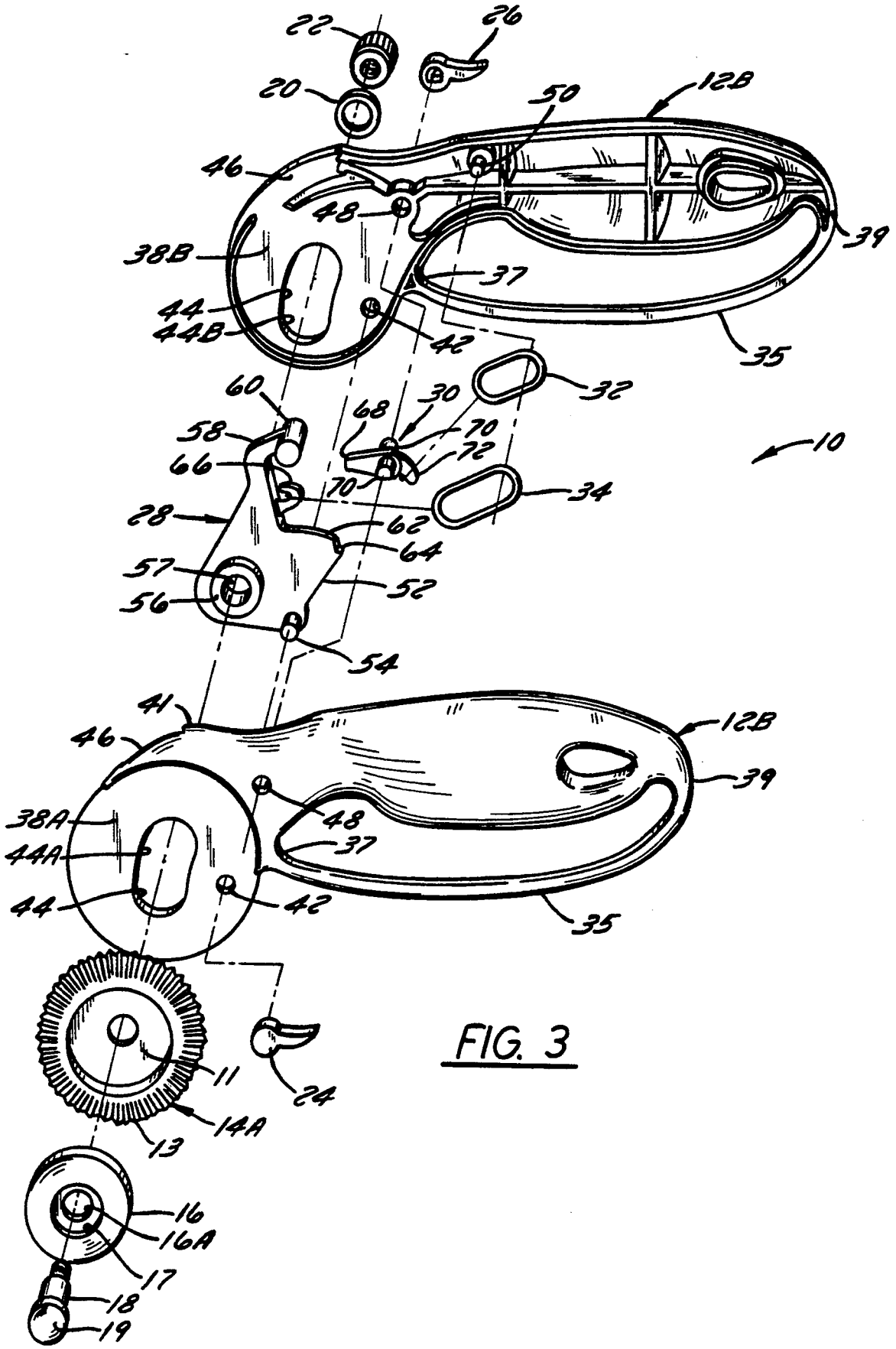
FIG. 3 is an exploded view of the rotary cutter.

Referring to FIGS. 1 and 2, the rotary cutter 10 of the type contemplated herein includes a body 12, a blade retainer 16, a retainer bolt 18, a spring washer 20, a retainer nut 22, and a lock lever 24. As best seen in FIG. 3, body 12 is formed of respective symmetrical side parts 12A and 12B which, in assembly, form an interior cavity therebetween. A pivoting member 28, a locking pawl 30, and respective elastic bands 32 and 34 are disposed within the body cavity. In accordance with the present invention cutting blades 14A or 14B are mounted on retainer bolt 18 and held in abutting relation to one or the other side of body 12.

Body 12 includes a handgrip portion 36 and a cylindrical head 38 interconnected by an integrally formed blending neck 40. As will be further described, handgrip 36 manifests a three dimensional configuration which not only comfortably fits either hand, but also, in cooperation with neck 40, permits the user to guide cutter 10 using either the thumb or forefinger, and optimizes downward and longitudinal (forward or rearward) force on blade 14A or 14B when in use.

Referring to FIGS. 1–3 and 7 the head 38 includes a planar disk or platform having substantially flat side surfaces 38A and 38B, manifesting a generally circular periphery. The side surfaces 38A and 38B are of a diameter greater than the diameter of blades 14A and 14B, and each side includes a transverse through bore 42 and an arcuate-shaped aperture 44 extending transversely therethrough (FIGS. 2, 3). The major arcs 44A and 44B of aperture 44 are concentric with bore 42.

Figure 6:
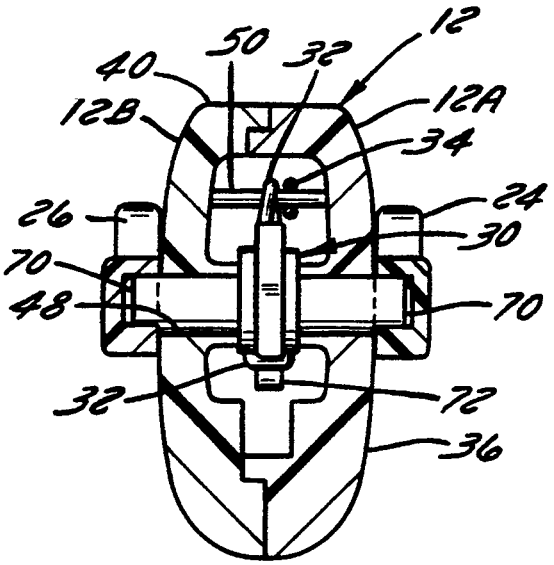
FIG. 6 is a cross sectional view taken on line 6—6 of FIG. 1.
Figure 9:
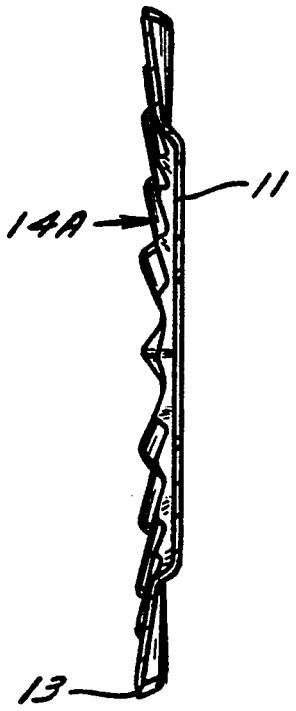
FIG. 9 is a cross sectional view taken on line 9—9 of FIG. 2.
Figure 7:
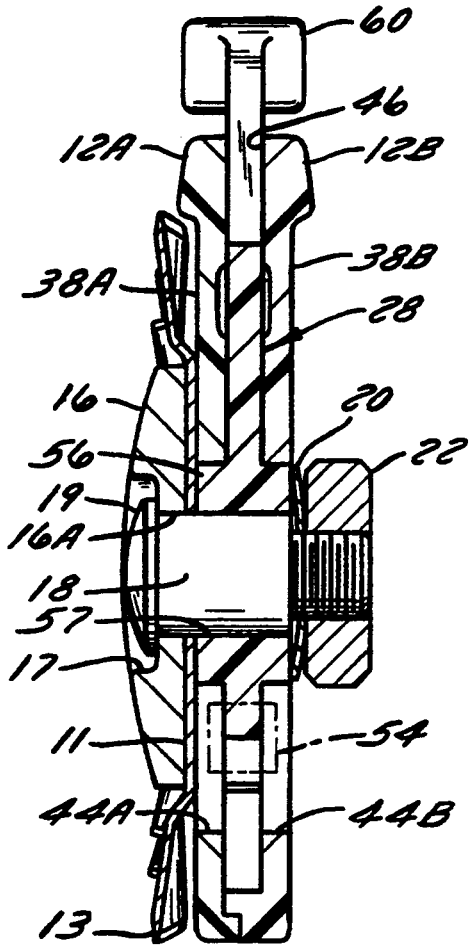
FIG. 7 is a cross sectional view taken on line 7—7 of FIG. 1.

Referring again to FIGS. 1 and 2, neck 40 provides a smooth, integral connection between handle portion 36 and head 38, and is contoured to receive a user's thumb or forefinger on the rear top surface thereof. Neck 40 includes a forward top transverse surface 41 comprising an arc concentric with bore 42, in which a longitudinally disposed slot 46 is formed. As best seen in FIGS. 3 and 6, respective apertures 48 are also formed in the sides of neck 40, rearwardly of bore 42 and slot 46. A pin 50 is formed on the interior of one or both of body side parts 12A and 12B. The relative disposition and dimensional relationships of the various components of body 12 will be described in more detail in conjunction with FIGS. 2 and 3.

The hand grip portion 36 is provided with a finger guard 35 formed as an integral part of the hand grip portion 36. In this regard, it should be noted that one end 37 of the guard 35 is formed as an integral part of the head 38 and the other end 39 extends rearward and is formed as an integral part of the end of the hand grip portion 36. With this arrangement the fingers of the operator are protected from the cutting edge of the blades 14A and 14B.

Referring to FIG. 3, pivoting member 28 is pivotally mounted within the head 38 and includes: a generally planar body 52; a pivot pin 54 extending perpendicularly from each side of body 52; respective cylindrical bosses 56 symmetrically disposed on each side of body 52 and having an axial bore 57 extending therethrough; a stem 58 terminating in a thumb lever 60; a major cammed surface 62 terminating at a ledge 64; and a hook 66. In assembly, the ends of pin 54 are received in bores 42; bosses 56 are received in said arcuate-shaped apertures 44; and stem 58 extends through slot 46, with lever 60 disposed exteriorly of platform 38.

The blades 14A and 14B are rotatably secured to boss 56 of pivoting member 28. In assembly, the end surfaces of the bosses 56 are, as best seen in FIG. 2, substantially coplanar with the flat surfaces 38A and 38B of head 38. One of the blades 14A or 14B is disposed adjacent head 38, and blade retainer 16 adjacent to one of the blades 14A or 14B, with central aperture 16A in registry with boss bore 57. Retainer bolt 18 is journalled through blade retainer 16, blade 14A or 14B, bosses 56, and spring washer 20 and is threadedly engaged by nut 22. The head 19 of retainer bolt 18 is suitably received within a counterbore 17 formed in retainer 16. A portion of the shaft of bolt 18 may be keyed, and bore 57 shaped accordingly, to prevent rotation of bolt 18 relative to pivoting member 28. With this arrangement the blade 14 and blade retainer 16 can be quickly and easily removed from the handle for cleaning and reassembling to maintain sanitary conditions.

Blade 14A or 14B is rotatable about the shaft of bolt 18. When nut 22 is fully engaged, spring washer 20 is compressed, causing retainer 16 to bear against blades 14A or 14B with a predetermined force so that a predetermined frictional resistance against rotation is effected. The blade 14A is provided with a cutting edge 13 having a zigzag or pinking pattern as shown in FIGS. 1, 2, 3 and 9. The blade 14B is provided with a cutting edge 15 having a wave pattern as shown in FIGS. 2A and 8.

In this regard the blade 14A is formed from a relatively thin flat metal disc having a thickness of approximately 0.016 inches. The cutting edge 13 on the outer perimeter of the blade 14A has an angle of convergence which is the same around the complete periphery of the blade. It should be noted that the cutting edge 13 around the periphery of the blade is formed by indenting the edge 13 of the blade at predetermined intervals around the periphery of the blade with the cutting edge 13 offset from the planar surface of the disc 11. The cutting edge 13 is offset to one side of the disc 11 to allow the disc 11 to be in sliding contact with the planar surface 38A or 38B of the head 38.

Figure 8:
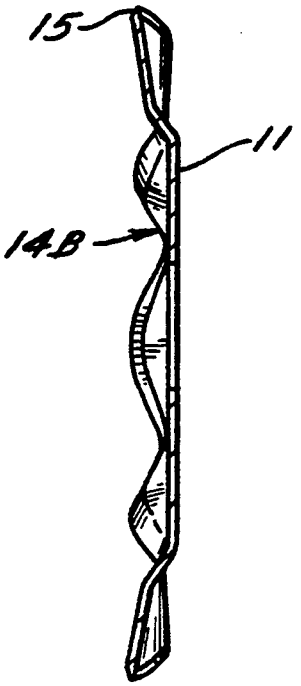
FIG. 8 is a cross sectional view taken on line 8—8 of FIG. 2A.

The blade 14B shown in FIGS. 2A and 8 is also formed from a thin flat metal disc 11 having a thickness of approximately 0.016 inches. The cutting edge 15 on the outer perimeter of blade 14B also has an angle of convergence which is the same around the complete blade circumference. The cutting edge 15 around the periphery of the disc 11 is formed by indenting the cutting edge 15 from one side of the blade so that the cutting edge is offset from the plane of disc 11.

Figure 4:
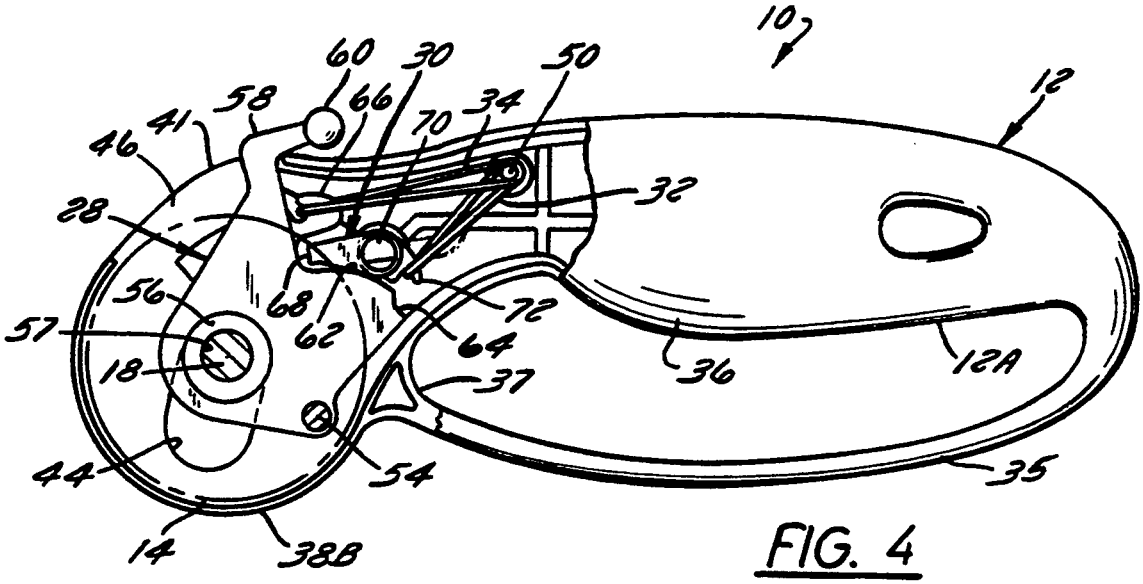
FIG. 4 is a side view of the rotary cutter with a portion broken away to show the pivoting assembly for the blade.
Figure 5:
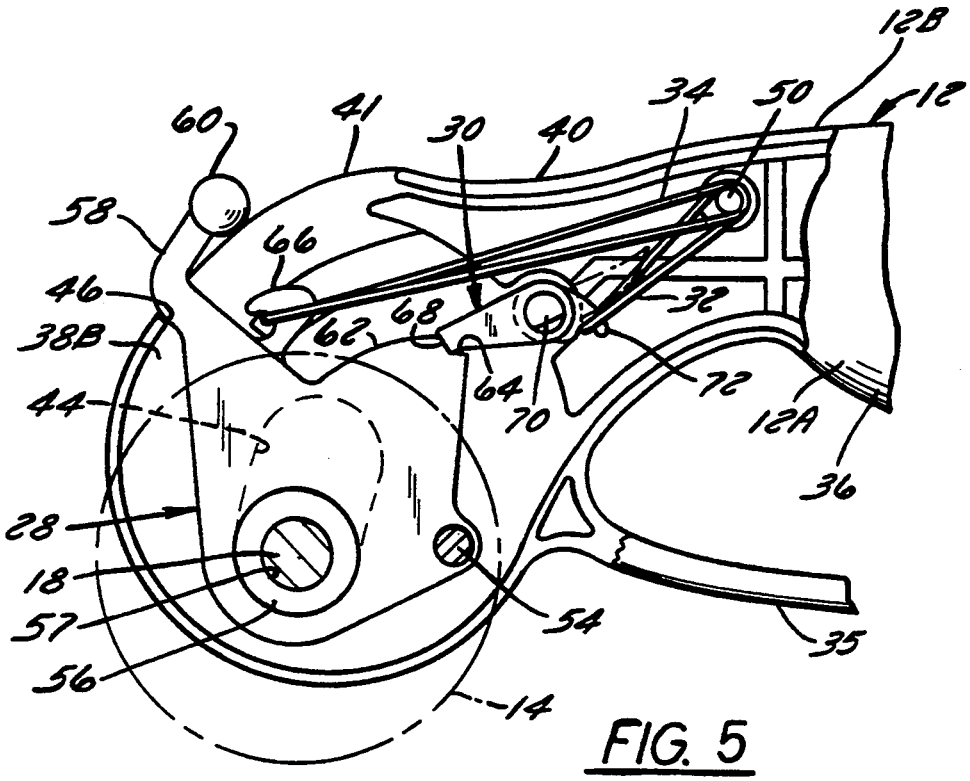
FIG. 5 is an enlarged view of the pivoting assembly.

Pivoting member 28 is employed to controllably move blade 14A or 14B relative to head 38 between cutting and retracted positions. Referring now to FIGS. 4 and 5, stem 58 may be made to travel the extent of slot 46, causing member 28 to pivot about pin 54, such that bosses 56 (and thus the axis of blades 14A and 14B to) travel through the arc defined by aperture 44. As shown in FIG. 4, when member 28 is in the rearmost (retracted) position, the edge of blades 14A and 14B is contained within the area of head 3%. The blade is thus retracted. As shown in FIG. 5, when actuator lever 60 is pushed forward, to place stem 58 in the vicinity of the forward extremity of slot 46, member 28 rotates counter-clockwise into a forward (cutting) position, in which a portion of the periphery of blade 14A or 14B extends beyond the periphery of cylindrical head 38. Blade 14A or 14B is thus disposed in an exposed (cutting) position.

Locking pawl 30, also pivotally mounted within handle 36, cooperates with lever 24 to selectively lock the blade 14A or 14B in the cutting position. Referring now to FIGS. 3 and 6, locking pawl 30 includes a terminal portion 68, respective cylindrical posts 70 keyed for rotation with internal key bores in levers 24 and 26, and an end hook portion 72. Posts 70 are journalled through apertures 48 in body sides 12A and 12B, and are affixed to levers 24 and 26 such that terminal portion 68 is selectively pivoted about the axis defined by posts 70 in response to rotation of either lever 24 or lever 26. Elastic band 32 is fixed over hook portion 72 of actuator pawl 30, and extends over post 50 to provide a counter-clockwise rotational bias on locking pawl 30. Member 28, on the other hand, is biased for clockwise rotation by elastic band 34; elastic band 34 is fixed to hook 66 at one end, and at the other to post 50.

As shown in FIGS. 4 and 5, the relative dimensions and dispositions of member 28 and pawl 30 are such that pawl terminal portion 68 normally rides on cam surface 62 of member 28. When member 28 is rotated counter-clockwise (by forward movement of stem 58 within slot 46), cam surface 62 moves relative to pawl 30, and pawl terminal portion 68, under counter-clockwise rotational bias, ultimately drops off cam surface 62 at a step or ledge 64 (at a point corresponding to stem 58 being located at the forward extremity of slot 46 and bosses 56 at the lower extremity of arcuate-shaped aperture 44) (FIG. 5). The end of pawl 30 lodges against ledge 64 of member 28, locking member 28 in the forward position.

To release pivoting member 28 from the forward position, lever 24 or 26 is rotated in a clockwise direction in FIG. 1, causing pawl 30 to likewise rotate, and lift out of ledge 64. The bias from elastic band 34 causes clockwise rotation of member 28, again disposing cam surface 62 under pawl 30. Member 28 thus, under bias, resumes the retracted position.

As previously mentioned, handgrip 36 manifests a contoured configuration which fits either the right or left hand comfortably, and permits the user to guide cutter 10 using either a thumb or forefinger, while at the same time exerting the necessary downward and forward force on blade 14A or 14B. The finger guard 35 provides protection from the blade 14A or 14B by preventing forward motion of the fingers of the operator.

Thus, it should be apparent that there has been provided in accordance with the present invention a rotary cutting blade assembly for a hand-held cutter that fully satisfies the aims and advantages set forth above. Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

The embodiments of the invention in which an exclusive property or privilege is claimed are defined as follows:

1. A hand-held rotary cutter of the type including a handle, a cylindrical head formed on one end of the handle, said head having an internal cavity and a planar surface on each side, and an actuating member pivotally mounted in the cavity, the improvement comprising a circular blade having a hub and a circular cutting edge formed around the perimeter of the hub, said cutting edge being offset to one side of said hub wherein said blade is mounted on the actuating member with the hub in abutting relation to one of the planar surfaces and a guard extending from the head to the handle and formed as an integral part of the head and the handle to protect the fingers of the operator.

2. The hand-held rotary cutter according to claim 1 wherein said cutting edge has a pinking pattern.

3. The hand-held rotary cutter according to claim 1 wherein said cutting edge has a wave pattern.

4. A hand-held rotary cutter of the type including a handle, a cylindrical head formed on one end of the handle, the head having an internal cavity and a planar surface on each side, and an activating member pivotally mounted in the cavity, the improvement comprising:

a finger guard extending from the head to the handle and formed as an integral part of the head and the handle and a circular blade mounted on the actuating member in abutting relation to one of the planar surfaces, said blade having a hub and a cutting edge formed around the perimeter of the hub and being offset from the hub of said blade.

5. The cutter according to claim 4 wherein said cutting edge has a pinking pattern.

6. The cutter according to claim 4 wherein said blade includes a cutting edge having a wave pattern.

* * * * *